US009878547B2

(12) United States Patent
Hamamoto et al.

(10) Patent No.: US 9,878,547 B2
(45) Date of Patent: Jan. 30, 2018

(54) CLEANING LIQUID SUPPLYING APPARATUS AND LIQUID DROPLET EJECTING APPARATUS INCLUDING THE SAME

(71) Applicant: SEIKO EPSON CORPORATION, Tokyo (JP)

(72) Inventors: Seiko Hamamoto, Azumino (JP); Toshio Kumagai, Shiojiri (JP); Hiroshi Asawa, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/462,407

(22) Filed: Mar. 17, 2017

(65) Prior Publication Data

US 2017/0274660 A1 Sep. 28, 2017

(30) Foreign Application Priority Data

Mar. 22, 2016 (JP) ..... 2016-057498

(51) Int. Cl.
*B41J 2/165* (2006.01)

(52) U.S. Cl.
CPC ..... *B41J 2/16535* (2013.01)

(58) Field of Classification Search
CPC ..... B41J 2/16535
See application file for complete search history.

(56) References Cited

U.S. PATENT DOCUMENTS 6,247,782 B1 * 6/2001 Takata ..... B41J 2/14201 347/30
6,742,882 B2 * 6/2004 Nakamura ..... B41J 2/175 347/89
7,014,303 B2 * 3/2006 Matsushita ..... B41J 2/19 347/85
2010/0231634 A1 9/2010 Yokota et al.
2014/0253634 A1 9/2014 Kobayashi et al.

FOREIGN PATENT DOCUMENTS

JP 2014-168912 9/2014
WO 2015146951 A1 10/2015

OTHER PUBLICATIONS

European Search Report issued in Application No. 17162360 dated Aug. 9, 2017.

* cited by examiner

*Primary Examiner* — Lamson Nguyen
(74) *Attorney, Agent, or Firm* — Workman Nydegger

(57) ABSTRACT

A cleaning liquid supplying apparatus includes a first storage section, a pressure-accumulating second storage section, a plurality of cleaning liquid ejecting sections, a liquid sending section, a plurality of individual flow channel opening/closing sections, and a control section. The first storage section stores cleaning liquid. The cleaning liquid ejecting sections are connected to the second storage section via a plurality of individual flow channels having upstream ends located at positions where the upstream ends are open to a liquid reservoir when a predetermined amount of the cleaning liquid is stored in the second storage section. The liquid sending section is provided midway along a first flow channel and sends the cleaning liquid in the first storage section to the second storage section. The individual flow channel opening/closing sections open/close the respective individual flow channels. The control section controls the liquid sending section so that a pressure in an air reservoir becomes a predetermined pressure.

18 Claims, 6 Drawing Sheets

CLEANING LIQUID SUPPLYING APPARATUS AND LIQUID DROPLET EJECTING APPARATUS INCLUDING THE SAME

BACKGROUND

1. Technical Field

The present invention relates to a cleaning liquid supplying apparatus that supplies cleaning liquid to a nozzle surface of a liquid droplet ejecting head mainly when the nozzle surface is wiped, and also relates to a liquid droplet ejecting apparatus including the cleaning liquid supplying apparatus.

2. Related Art

As this type of cleaning liquid supplying apparatus, there is known a cleaning liquid supplying apparatus incorporated in a maintenance unit for a print head that ejects UV ink by using an ink jet process, the cleaning liquid supplying apparatus including a cleaning liquid supplying pipe and a cleaning liquid supply switching unit (see JP-A-2014-168912).

A plurality of maintenance units are provided so as to correspond to a plurality of print heads. Each maintenance unit includes a moving body including a wiper that wipes a nozzle forming surface of the print head, caps that cap the nozzle forming surface, and a support member that supports the wiper and the caps, and a wiper driving mechanism that moves the moving body in a wiping direction. Further, each maintenance unit includes a head driving mechanism that moves the print head between a cleaning position and a receding position, and a cleaning liquid supplying pipe and a cleaning liquid supply switching unit that supply cleaning liquid to the print head.

The cleaning liquid supplying pipe is arranged at the side of the print head which has moved to the cleaning position. The cleaning liquid supplying pipe has a plurality of ejecting ports arrayed in an extending direction. At the time of wiping with the wiper, the cleaning liquid supply switching unit is operated so as to eject the cleaning liquid from the plurality of ejecting ports toward the side surface of the print head.

It is assumed that the cleaning liquid supplying system including the cleaning liquid supplying pipe and the cleaning liquid supply switching unit also includes a cleaning liquid tank that stores the cleaning liquid, and a cleaning liquid pump that sends the cleaning liquid in the cleaning liquid tank to the cleaning liquid supplying pipe. In this case, a plurality of cleaning liquid supplying pipes are provided so as to correspond to the plurality of print heads. Therefore, it is assumed that the cleaning liquid tube that connects the cleaning liquid tank, the cleaning liquid pump, and the plurality of cleaning liquid supplying pipes to one another is constituted by a main tube that extends from the cleaning liquid tank via the cleaning liquid pump, and a plurality of branch tubes that branch from the main tube on the upstream side of the plurality of cleaning liquid supplying pipes. Further, it is assumed that opening/closing valves are provided in the plurality of branch tubes, respectively, thereby constituting the cleaning liquid supply switching unit.

In the cleaning liquid supplying system that supplies the cleaning liquid from the single cleaning liquid pump to the plurality of cleaning liquid supplying pipes as in the above-mentioned assumptions, there is a problem that the amount of cleaning liquid to be ejected from each cleaning liquid supplying pipe may vary depending on the number of opening/closing valves that are opened simultaneously. Specifically, in this cleaning liquid supplying system, the ejection amount of the cleaning liquid pump equals the total sum of the amounts of cleaning liquid supplied to the plurality of cleaning liquid supplying pipes, and hence the amount of cleaning liquid supplied to each cleaning liquid supplying pipe increases as the number of opening/closing valves opened decreases, whereas the amount of cleaning liquid supplied to each cleaning liquid supplying pipe decreases as the number of opening/closing valves opened increases. Therefore, there is a problem that the ejection flow rate and the ejection pressure of each cleaning liquid supplying pipe may become unstable. As a matter of course, the problem may be solved when a plurality of cleaning liquid pumps are provided so as to correspond to the plurality of cleaning liquid supplying pipes. However, the provision of a plurality of cleaning liquid pumps may raise the need for an installation space corresponding to the plurality of cleaning liquid pumps, and may cause an increase in cost.

SUMMARY

An advantage of some aspects of the invention is that a cleaning liquid supplying apparatus in which the flow rate of cleaning liquid to be supplied to each cleaning liquid ejecting section can be stabilized with a simple configuration is provided, and a liquid droplet ejecting apparatus including the cleaning liquid supplying apparatus is provided.

A cleaning liquid supplying apparatus according to a first aspect of the invention includes a first storage section, a pressure-accumulating second storage section, a plurality of cleaning liquid ejecting sections, a liquid sending section, a plurality of individual flow channel opening/closing sections, and a control section. The first storage section stores cleaning liquid. The second storage section is connected to the first storage section via a first flow channel and includes an air reservoir formed at an upper part of the second storage section and a liquid reservoir formed at a lower part of the second storage section by the cleaning liquid when a predetermined amount of the cleaning liquid is stored in the second storage section. The cleaning liquid ejecting sections are connected to the second storage section via a plurality of individual flow channels having upstream ends located at positions where the upstream ends are open to the liquid reservoir when the predetermined amount of the cleaning liquid is stored in the second storage section. The liquid sending section is provided midway along the first flow channel and sends the cleaning liquid in the first storage section to the second storage section. The individual flow channel opening/closing sections open/close the respective individual flow channels. The control section controls the liquid sending section so that a pressure in the air reservoir becomes a predetermined pressure.

According to this configuration, the second storage section is replenished with the cleaning liquid in the first storage section via the first flow channel when the liquid sending section is driven. Simultaneously, the pressure in the second storage section becomes the predetermined pressure. When the individual flow channel opening/closing sections open the individual flow channels in this state, the cleaning liquid in the second storage section is sent to the respective cleaning liquid ejecting sections under pressure. In this case, the cleaning liquid is sent to the plurality of cleaning liquid ejecting sections with the pressure applied to the second storage section, and hence, as long as the pressure in the second storage section is maintained at the predetermined pressure, the flow rate of the cleaning liquid to be supplied to the cleaning liquid ejecting section becomes constant irrespective of the number of simultaneously opened individual flow channel opening/closing sections. That is, the flow rate of the cleaning liquid to be supplied to each cleaning liquid ejecting section can be stabilized even with a simple configuration including a single first storage section and a single liquid sending section.

It is preferred that the liquid sending section send out the liquid with a pump. Further, it is preferred that the control section drive the liquid sending section based on a detection result from a pressure detecting section provided on the second storage section. The amount of cleaning liquid in the second storage section can be changed as appropriate from zero to full. As a matter of course, the aspect of the invention also includes a cleaning liquid supplying apparatus in which no cleaning liquid is contained in the second storage section (the amount of cleaning liquid is zero).

In this case, it is preferred that a downstream end of the first flow channel be located at a position where the downstream end is open to the liquid reservoir when the predetermined amount of the cleaning liquid is stored in the second storage section.

According to this configuration, formation of waves on the surface of the liquid in the second storage section (liquid reservoir) is suppressed when the liquid sending section sends out the cleaning liquid. Thus, formation of bubbles in the cleaning liquid and entry of air into the individual flow channel can be prevented effectively.

It is preferred that the cleaning liquid supplying apparatus further include a cleaning liquid returning section that includes a return flow channel through which the cleaning liquid in the second storage section is returned to the first storage section and, when the liquid sending section is stopped by the control section, returns the cleaning liquid in the second storage section to the first storage section via the return flow channel so that a liquid level of the liquid reservoir becomes a predetermined liquid level.

In the second storage section during the operation, the pressure is constantly applied to the cleaning liquid, and hence the air in the air reservoir is liable to be mixed into the cleaning liquid.

According to this configuration, when the driving of the liquid sending section is stopped, the cleaning liquid returning section returns the cleaning liquid in the second storage section to the first storage section, and hence the liquid level of the liquid reservoir becomes the predetermined liquid level. Therefore, the air reservoir and the liquid reservoir of the second storage section can constantly be maintained under (reset to) appropriate conditions even if the air is mixed into the cleaning liquid.

In this case, it is preferred that the cleaning liquid returning section include the return flow channel having an upstream end that is open at a position corresponding to the predetermined liquid level, and a return flow channel opening/closing section that opens/closes the return flow channel, and that the control section control the return flow channel opening/closing section to open the return flow channel when the liquid sending section is stopped.

According to this configuration, the cleaning liquid in the second storage section can be returned (sent under pressure) to the first storage section with the pressure in the second storage section when the driving of the liquid sending section is stopped. Further, the cleaning liquid can be returned to the first storage section so that the liquid level of the second storage section becomes the predetermined liquid level owing to the position of the upstream end of the return flow channel. Thus, the liquid level of the cleaning liquid and the air reservoir in the second storage section can appropriately be maintained with a simple structure and with no need for power.

In this case, it is preferred that the cleaning liquid supplying apparatus further include a filter that is provided midway along the first flow channel between the first storage section and the liquid sending section, and that a downstream end of the return flow channel be connected to the first flow channel between the filter and the liquid sending section.

According to this configuration, the cleaning liquid to be returned from the second storage section to the first storage section passes through the filter in a reverse direction. Thus, clogging of the filter is removed, and hence the frequency of maintenance for the filter can be reduced.

It is preferred that the first storage section be arranged at a lower position in a gravity direction than the second storage section, that the cleaning liquid supplying apparatus further include an atmosphere opening/closing section that is controlled by the control section to open/close the air reservoir of the second storage section to/from an atmosphere, and that the control section open the atmosphere opening/closing section at a timing when the pressure in the air reservoir is decreased to an atmospheric pressure after the return flow channel is opened.

According to this configuration, the cleaning liquid in the second storage section is returned to the first storage section with the pressure in the second storage section, and then the cleaning liquid can continuously be returned to the first storage section with a siphon operation of the return flow channel. That is, the cleaning liquid can securely be returned to the first storage section so that the liquid level of the second storage section becomes the predetermined liquid level. It is preferred that the atmosphere opening/closing section open the air reservoir to the atmosphere at a timing immediately before or immediately after the pressure in the air reservoir is decreased to the atmospheric pressure.

In this case, it is preferred that the first storage section include an atmospheric-pressure air reservoir that is open to the atmosphere, and that the atmosphere opening/closing section include an air flow channel that connects the air reservoir and the atmospheric-pressure air reservoir to each other, and an air flow channel opening/closing section that is controlled by the control section to open/close the air flow channel.

According to this configuration, the second storage section can be opened to the atmosphere only by opening the air flow channel with the air flow channel opening/closing section. Further, one end of the air flow channel is connected to the atmospheric-pressure air reservoir of the first storage section, and hence the vaporized cleaning liquid (which may have an odor in some cases) can be prevented from being released to the atmosphere.

It is preferred that the cleaning liquid supplying apparatus further include a pressure detecting section that detects the pressure in the second storage section, and that the control section control the liquid sending section based on a detection result from the pressure detecting section.

According to this configuration, the liquid sending section can be controlled with a simple control configuration. In this case, it is preferred that an upper limit and a lower limit (thresholds) of the detected pressure be determined in advance, that the liquid sending section be driven when the detected pressure has reached the lower limit, and that the driving of the liquid sending section be stopped when the detected pressure has reached the upper limit. In this case, the "predetermined pressure" described above means a pressure range from the lower limit to the upper limit.

Similarly, it is preferred that the cleaning liquid supplying apparatus further include a piston-like member that is provided on an inner peripheral surface of the second storage section in an air-tight fashion and in a freely ascending/descending fashion and ascends/descends with a balance between a weight of the piston-like member and the pressure of air in the air reservoir, and a position detecting section that is provided in place of the pressure detecting section and detects a position of the piston-like member in an ascending/descending direction, and that the control section control the liquid sending section based on a detection result from the position detecting section.

According to this configuration, the "predetermined pressure" can indirectly be controlled by controlling the liquid sending section based on the detection result from the position detecting section that detects the position of the piston-like member in the ascending/descending direction. In this case, even if an abrupt pressure fluctuation has occurred on the liquid sending section side or the cleaning liquid ejecting section side, the pressure fluctuation can be absorbed by the ascending/descending of the piston-like member. Thus, the cleaning liquid can stably be supplied to each cleaning liquid ejecting section.

A liquid droplet ejecting apparatus according to a second aspect of the invention includes the cleaning liquid supplying apparatus described above, a plurality of liquid droplet ejecting heads, and a plurality of wiping apparatuses. The liquid droplet ejecting heads eject functional liquid and are provided so as to correspond to the plurality of cleaning liquid ejecting sections. The wiping apparatuses wipe nozzle surfaces of the respective liquid droplet ejecting heads in a state in which the cleaning liquid is supplied from the respective cleaning liquid ejecting sections to the nozzle surfaces.

According to this configuration, an appropriate amount of cleaning liquid can stably be supplied to the nozzle surface of each liquid droplet ejecting head, and hence the nozzle surface can be wiped efficiently.

BRIEF DESCRIPTION OF THE DRAWINGS

The invention will be described with reference to the accompanying drawings, wherein like numbers reference like elements.

DESCRIPTION OF EXEMPLARY EMBODIMENTS

A cleaning liquid supplying apparatus and a liquid droplet ejecting apparatus including the cleaning liquid supplying apparatus according to an embodiment of the invention are described below with reference to the accompanying drawings. The liquid droplet ejecting apparatus is an apparatus that performs printing (printing apparatus) by sending out a recording medium by using a roll-to-roll process and ejecting ultraviolet curable ink (hereinafter referred to as "UV ink") from an ink-jet type liquid droplet ejecting head to the recording medium thus being sent out. The cleaning liquid supplying apparatus is incorporated in a maintenance section for the liquid droplet ejecting apparatus, which performs maintenance for the liquid droplet ejecting head, and supplies cleaning liquid so that the cleaning liquid adheres to the liquid droplet ejecting head when the liquid droplet ejecting head is wiped.

Liquid Droplet Ejecting Apparatus

Figure 1:
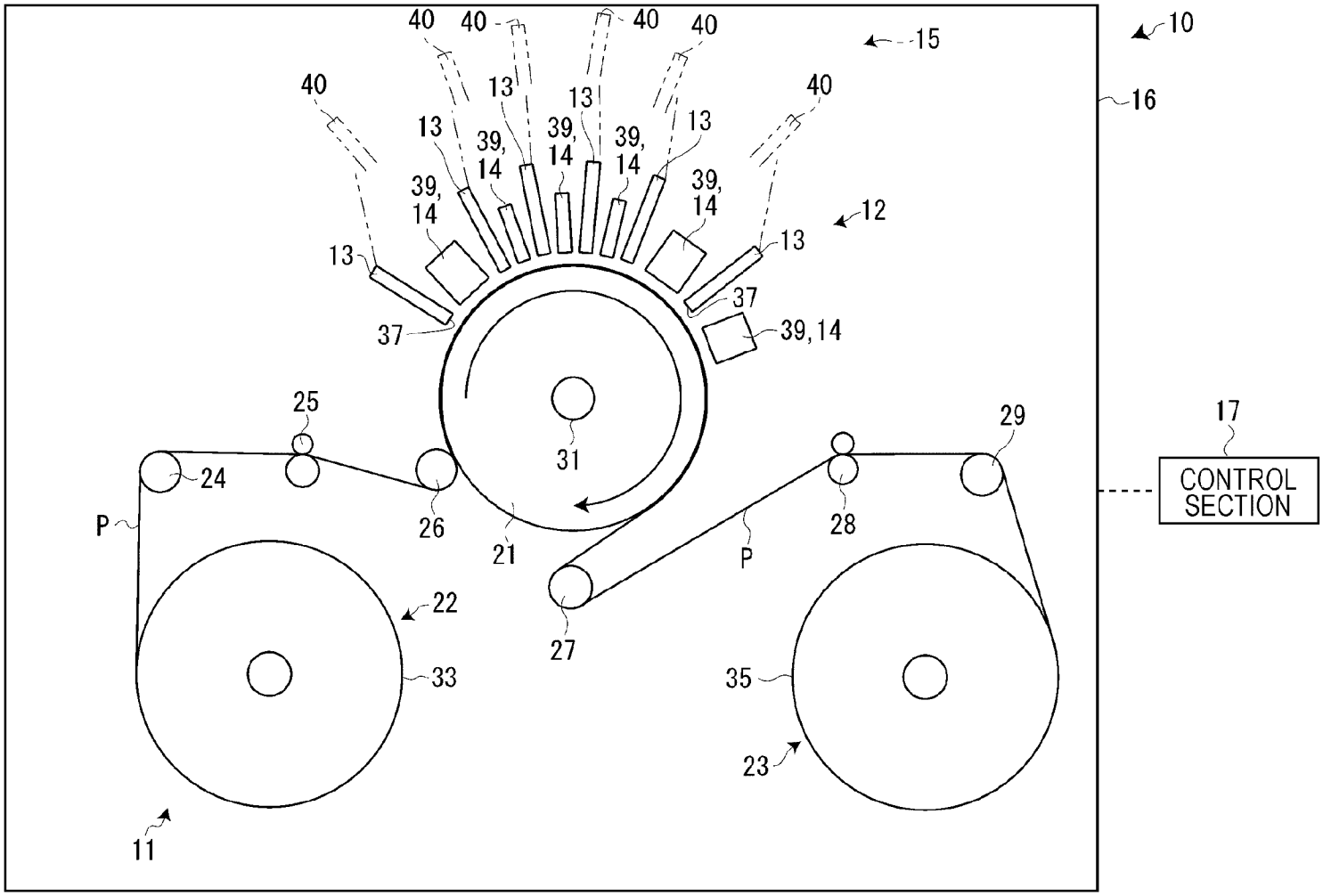
FIG. 1 is a structural diagram schematically illustrating the structure of a liquid droplet ejecting apparatus according to an embodiment.

FIG. 1 is a structural diagram schematically illustrating the structure of the liquid droplet ejecting apparatus. As illustrated in FIG. 1, a liquid droplet ejecting apparatus 10 includes a medium sending section 11 that sends out a recording medium P by using a roll-to-roll process, an ink ejecting section 12 that includes a plurality of liquid droplet ejecting heads 13 and performs printing by ejecting UV ink to the recording medium P thus being sent out, and an ultraviolet ray radiating section 14 that radiates ultraviolet rays to cure the UV ink adhering to the recording medium P through the ink ejection. Further, the liquid droplet ejecting apparatus 10 includes a maintenance section 15 that performs maintenance for the plurality of liquid droplet ejecting heads 13, a safety cover 16 that covers those constituent apparatuses, and a control section 17 that integrally controls those constituent apparatuses. The material for the recording medium P is not particularly limited, and various materials such as paper-based or film-based materials may be used.

The medium sending section 11 includes a rotary drum 21 that is a main body, a feeding unit 22 that feeds the recording medium P in a roll shape toward the rotary drum 21, and a take-up unit 23 that takes up, into a roll shape, the recording medium P which is sent from the rotary drum 21 and is subjected to printing. Further, the medium sending section 11 includes an upstream intermediate roller 24, feeding rollers 25, and a send-in roller 26 that are located between the feeding unit 22 and the rotary drum 21. Similarly, the medium sending section 11 includes a send-out roller 27, discharging rollers 28, and a downstream intermediate roller 29 that are located between the rotary drum 21 and the take-up unit 23.

The rotary drum 21 is formed in a freely rotatable fashion, and rotates with a frictional force of the recording medium P that is being sent out by the feeding rollers 25 and the discharging rollers 28. An encoder (not shown) is provided to a shaft 31 of the rotary drum 21. The feeding unit 22 includes a feeding reel 33 around which the recording medium P is wound, and rotates through driving of a motor in synchronization with the sending out of the recording medium P by the feeding rollers 25, thereby feeding the recording medium P. The upstream intermediate roller 24 is a freely rotatable roller, and changes the route of the recording medium P fed from the feeding unit 22 toward the feeding rollers 25.

The feeding rollers 25 are nip rollers to be driven by a motor, and send out the recording medium P so that the rotary drum 21 rotates at a predetermined rotational speed (circumferential speed) based on a detection result from the encoder of the rotary drum 21. The send-in roller 26 is a freely rotatable roller, and changes the route of the recording medium P sent from the feeding rollers 25 so that the recording medium P is wound around the rotary drum 21.

The send-out roller 27 is a freely rotatable roller, and changes the route of the recording medium P sent from the rotary drum 21 toward the discharging rollers 28.

The discharging rollers 28 are nip rollers to be driven by a motor, and send out the recording medium P while applying a predetermined back tension to the recording medium P wound around the rotary drum 21. The downstream intermediate roller 29 is a freely rotatable roller, and changes the route of the recording medium P sent from the discharging rollers 28 toward the take-up unit 23. The take-up unit 23 includes a take-up reel 35 that takes up the recording medium P, and rotates through driving of a motor in synchronization with the sending out of the recording medium P by the discharging rollers 28, thereby taking up the recording medium P.

The recording medium P is sent out along the outer peripheral surface of the rotary drum 21 as the rotary drum 21 rotates. The ink ejecting section 12 (plurality of liquid droplet ejecting heads 13) faces an upper part of the outer peripheral surface of the rotary drum 21 with a predetermined gap secured therebetween, and ejects UV ink onto (performs printing on) the recording medium P thus being sent out. That is, the rotary drum 21 functions as a platen that supports the recording medium P to constitute a part of the sending route thereof and faces the ink ejecting section 12 across the recording medium P.

The ink ejecting section 12 includes six liquid droplet ejecting heads 13 arrayed along the outer peripheral surface of the rotary drum 21. The six liquid droplet ejecting heads 13 correspond to UV inks of six colors, and are arranged in the order of white, yellow, cyan, magenta, black, and clear (transparent) from the upstream side in the sending direction of the recording medium P (hereinafter referred to simply as "sending direction"). The yellow, cyan, magenta, and black UV inks are used for forming color images, and the white UV ink is used as a background color for a transparent recording medium P or the like. The clear UV ink is superimposed on color images at the time of printing, thereby imparting a gloss, matte, or other appearance.

Each liquid droplet ejecting head 13 has two nozzle arrays 37 (see FIG. 2) that are positionally shifted from each other by a half nozzle pitch. The two nozzle arrays 37 extend in a direction (sheet width direction) orthogonal to the sending direction of the recording medium P, that is, in a depth direction of the drawing sheet of FIG. 1. A color image is printed by selectively driving (ejecting ink from) the plurality of liquid droplet ejecting heads 13 for the recording medium P that is being sent out at a constant speed by the rotary drum 21.

The ultraviolet ray radiating section 14 includes six radiating units 39 corresponding to the six liquid droplet ejecting heads 13. Each radiating unit 39 is arranged on the downstream side in the sending direction with respect to the corresponding liquid droplet ejecting head 13, and the six liquid droplet ejecting heads 13 and the six radiating units 39 are alternately arranged in the sending direction. Three radiating units 39 corresponding to the yellow, cyan, and magenta liquid droplet ejecting heads 13 out of the six radiating units 39 are used for temporarily curing UV ink.

Three radiating units 39 corresponding to the white, black, and clear liquid droplet ejecting heads 13 out of the six radiating units 39 are used for completely curing UV ink. The radiating units 39 for temporary curing temporarily cure UV ink that has landed on the recording medium P so that the UV ink spreads under desired conditions. The radiating units 39 for complete curing completely cure the UV ink that has landed on the recording medium P.

The maintenance section 15 includes six maintenance units 40 corresponding to the six liquid droplet ejecting heads 13. Each maintenance unit 40 is arranged on the far side of the drawing sheet of FIG. 1 with respect to the corresponding liquid droplet ejecting head 13. Each maintenance unit 40 performs maintenance such as cleaning, wiping, and capping for the liquid droplet ejecting head 13. Further, the maintenance section 15 includes a cleaning liquid supplying apparatus 60 that supplies cleaning liquid to the six liquid droplet ejecting heads 13 as appropriate at the time of wiping (see FIG. 2). Description is given below taking as an example a maintenance unit 40 which the liquid droplet ejecting head 13 faces in a downward posture.

Maintenance Unit

Figure 2:
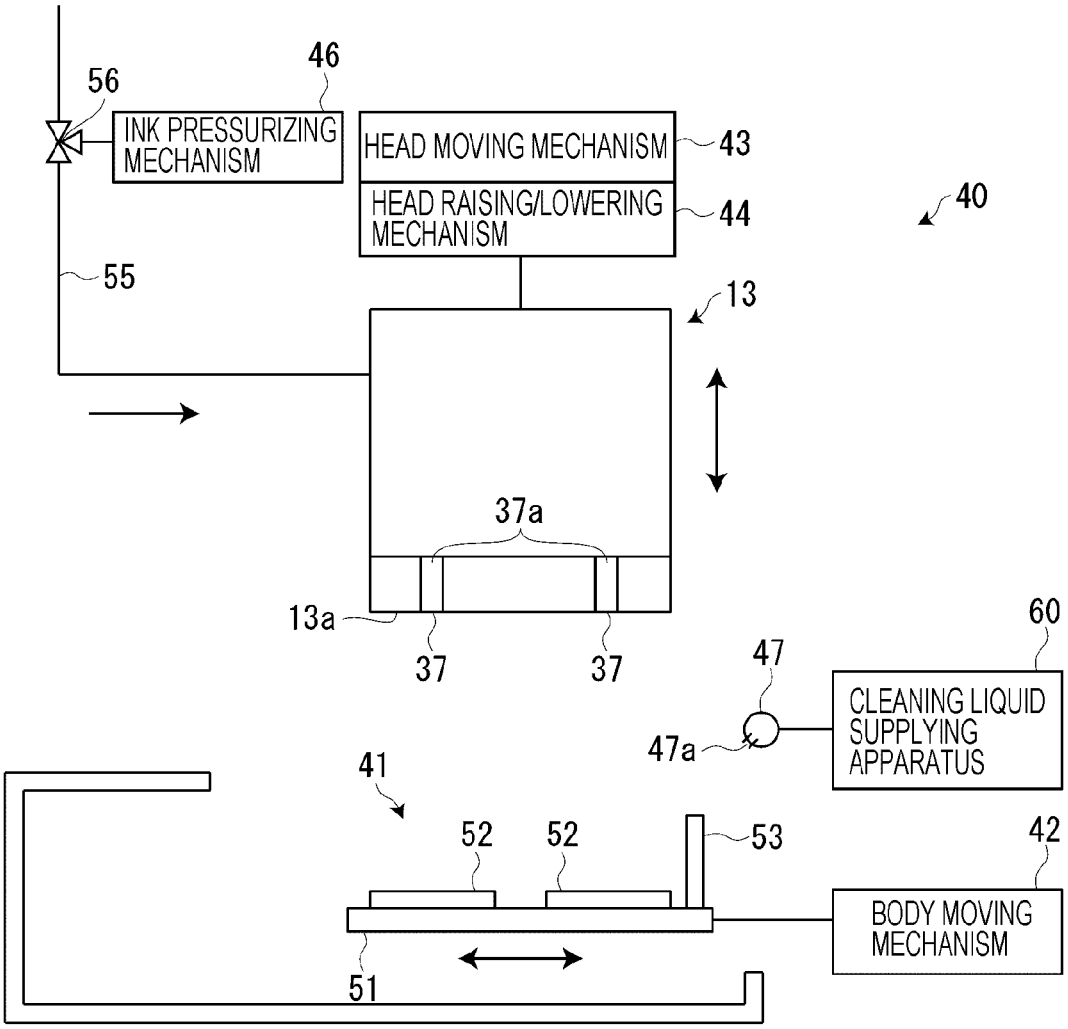
FIG. 2 is a structural diagram schematically illustrating the structure of a maintenance section of the liquid droplet ejecting apparatus.

As illustrated in FIG. 2, each maintenance unit 40 includes a body unit 41 that performs wiping and capping for the liquid droplet ejecting head 13, a body moving mechanism 42 that moves the body unit 41 in a direction orthogonal to the nozzle array 37 of the liquid droplet ejecting head 13, a head moving mechanism 43 that moves the liquid droplet ejecting head 13 between a printing position where the liquid droplet ejecting head 13 faces the rotary drum 21 and a maintenance position where the liquid droplet ejecting head 13 faces the body unit 41, and a head raising/lowering mechanism 44 that is incorporated in the head moving mechanism 43 and raises/lowers the liquid droplet ejecting head 13.

Further, the maintenance unit 40 includes an ink pressurizing mechanism 46 that pressurizes UV ink to be supplied to the liquid droplet ejecting head 13, and a cleaning liquid ejecting section 47 that supplies cleaning liquid to the liquid droplet ejecting head 13 at the time of wiping. The cleaning liquid ejecting section 47 is connected to the cleaning liquid supplying apparatus 60. Those constituent apparatuses are controlled by the control section 17. Note that a "wiping apparatus" according to an aspect of the invention includes the body unit 41, the body moving mechanism 42, and the head raising/lowering mechanism 44.

The body unit 41 includes a unit base 51 formed so as to be freely movable in the direction orthogonal to the nozzle array 37 of the liquid droplet ejecting head 13, a pair of head caps 52 provided on the unit base 51, and a wiper 53 provided upright at the end of the unit base 51. The body moving mechanism 42 reciprocally moves the body unit 41 in the direction orthogonal to the nozzle array 37 when a nozzle surface 13*a* of the liquid droplet ejecting head 13 is wiped with the wiper 53. Further, the body moving mechanism 42 moves the head caps 52 to a position immediately below the liquid droplet ejecting head 13.

The head raising/lowering mechanism 44 raises/lowers, with the maintenance position set as a home position of maintenance, the liquid droplet ejecting head 13 between the home position, a wiping position where the wiper 53 is pressed against the liquid droplet ejecting head 13, a cleaning position where the liquid droplet ejecting head 13 is brought closer to the head caps 52 at the time of pressure cleaning described later, and a capping position where the nozzle surface 13*a* is brought into contact with the head caps 52. At the time of pressure cleaning described later, the ink pressurizing mechanism 46 pressurizes UV ink to be supplied to the liquid droplet ejecting head 13, thereby forcefully ejecting the UV ink from nozzles 37*a* of the liquid droplet ejecting head 13. In this case, the ink pressurizing mechanism 46 is formed of a pump or the like that is connected via a three-way valve 56 to an ink supplying tube 55 connected to the liquid droplet ejecting head 13.

The cleaning liquid ejecting section 47 causes cleaning liquid to adhere to the side surface of the liquid droplet ejecting head 13 prior to the wiping operation with the wiper 53. The side surface is a surface of the liquid droplet ejecting head 13 on a side adjacent to the nozzle surface 13*a* of the head. Further, the cleaning liquid ejecting section 47 is arranged near the side surface of the liquid droplet ejecting head 13 which has moved to the wiping position, and is extends along at least part of the side surface of the liquid droplet ejecting head 13. Although the details are described later, an individual opening/closing valve 68 (see FIG. 4) of the cleaning liquid supplying apparatus 60 to which the cleaning liquid ejecting section 47 is connected is opened to eject cleaning liquid from a plurality of ejecting ports 47*a*, thereby causing an appropriate amount of cleaning liquid to adhere to the side surface of the liquid droplet ejecting head 13. The cleaning liquid adhering to the liquid droplet ejecting head 13 runs down toward the end (corner) of the nozzle surface 13*a*, and the nozzle surface 13*a* is wiped so that the cleaning liquid is caught by the wiper 53 that moves in order to perform wiping. The cleaning liquid ejecting section 47 is a component of the maintenance unit 40, and is also a component of the cleaning liquid supplying apparatus 60.

Maintenance Operation

A control system for maintenance is described, and a maintenance operation to be controlled by the control system is briefly described.

Figure 3:
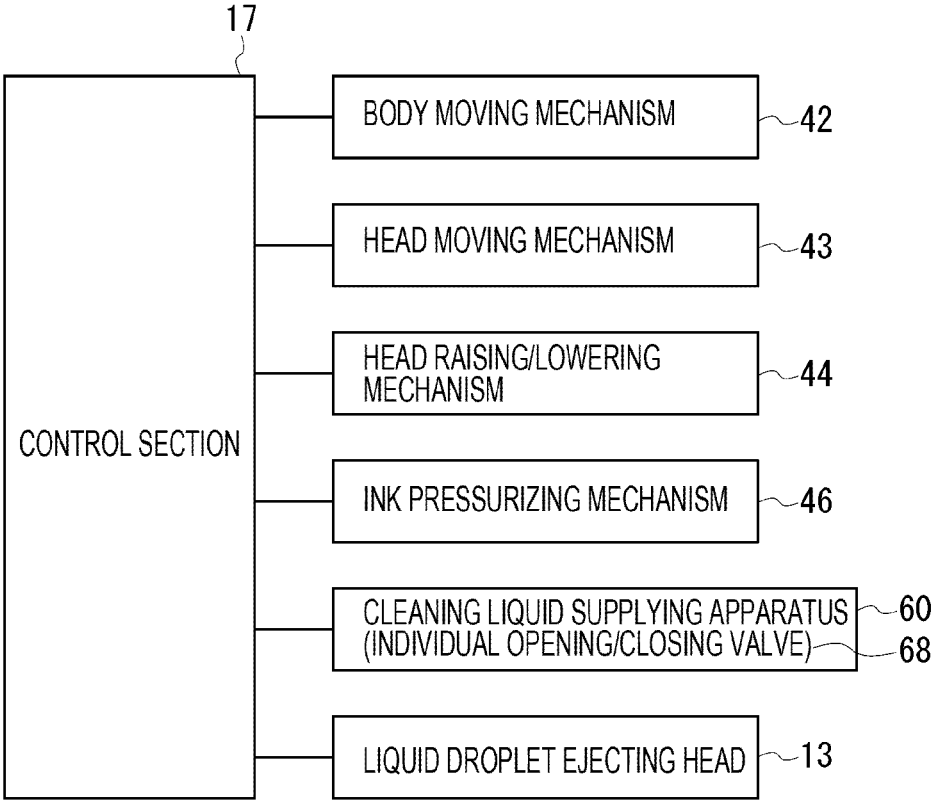
FIG. 3 is a block diagram of a control system for the maintenance section.

As illustrated in FIG. 3, the body moving mechanism 42, the head moving mechanism 43, the head raising/lowering mechanism 44, and the ink pressurizing mechanism 46 are connected to the control section 17. Further, the cleaning liquid supplying apparatus 60 and the liquid droplet ejecting head 13 are connected to the control section 17.

The maintenance operation is performed in the order of wiping, pressure cleaning, finish wiping, and flushing. When the operation of the liquid droplet ejecting apparatus 10 is stopped, capping is performed.

When the liquid droplet ejecting apparatus 10 is set to a maintenance mode, the control section 17 drives the head moving mechanism 43 to move the liquid droplet ejecting head 13 from the printing position to the maintenance position. Then, the control section 17 drives the head raising/lowering mechanism 44 to move the liquid droplet ejecting head 13 to the wiping position. At the timing when the liquid droplet ejecting head 13 has moved to the wiping position, the control section 17 opens the individual opening/closing valve 68 so as to cause cleaning liquid to adhere to the liquid droplet ejecting head 13 via the cleaning liquid ejecting section 47. Then, the control section 17 drives the body moving mechanism 42 to wipe the nozzle surface 13*a* with the wiper 53. In the wiping, the wiper 53 is reciprocally moved a plurality of times to mainly remove foreign substances adhering to the nozzle surface 13*a*. The cleaning liquid ejecting section 47 ejects the cleaning liquid every time the wiper 53 performs one reciprocal movement.

When the wiping is completed in this manner, the control section 17 drives the head raising/lowering mechanism 44 to move the liquid droplet ejecting head 13 to the cleaning position, and also drives the body moving mechanism 42 so as to cause the head caps 52 to face a portion immediately below the nozzle arrays 37 of the liquid droplet ejecting head 13. The control section 17 drives the ink pressurizing mechanism 46 to pressurize UV ink so as to forcefully eject the UV ink from all the nozzles 37*a* of the liquid droplet ejecting head 13. In this manner, an air bubble or cleaning liquid which has entered the nozzles 37*a* at the time of wiping is removed. In the pressure cleaning, the liquid droplet ejecting head 13 is not driven.

When the pressure cleaning is completed in this manner, finish wiping is performed with the wiper 53 through the procedure of the wiping described above. In the finish wiping, the wiper 53 is caused to perform one reciprocal movement so as to wipe the UV ink adhering to the nozzle surface 13*a*. Next, the control section 17 drives the liquid droplet ejecting head 13 to perform flushing (discarding ejection) with the head caps 52 located immediately below the nozzle arrays 37 of the liquid droplet ejecting head 13. In this manner, appropriate menisci are formed in the nozzles 37*a* of the liquid droplet ejecting head 13. Lastly, the control section 17 returns the liquid droplet ejecting head 13 and the body unit 41 to the initial positions, and the series of processes in the maintenance operation is completed.

Cleaning Liquid Supplying Apparatus of First Embodiment

Next, the cleaning liquid supplying apparatus 60 according to a first embodiment is described with reference to FIG. 4. As described above, the cleaning liquid supplying apparatus 60 supplies cleaning liquid to the six cleaning liquid ejecting sections 47 of the six maintenance units 40.

Figure 4:
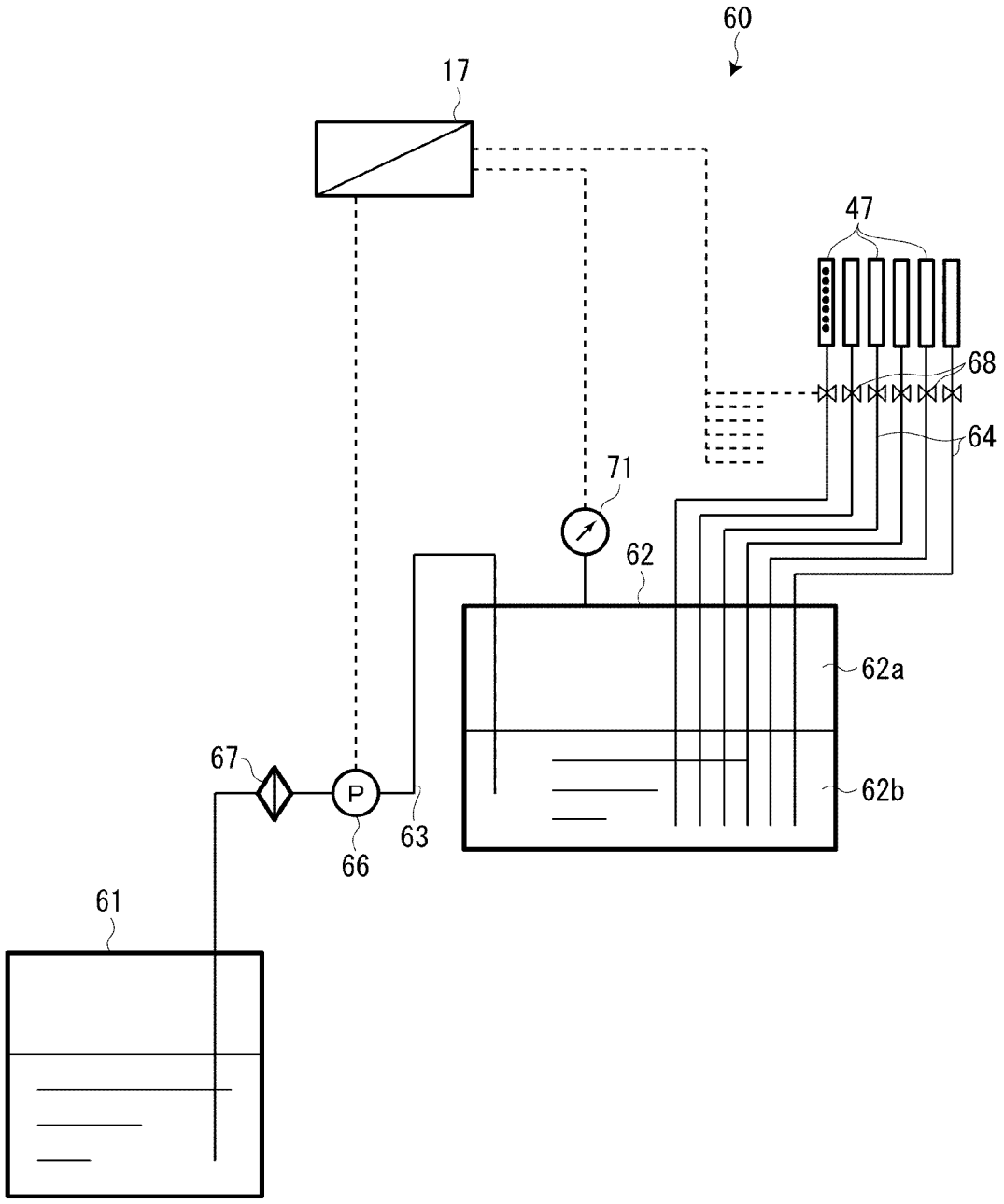
FIG. 4 is a schematic diagram of a cleaning liquid supplying apparatus according to a first embodiment.

As illustrated in FIG. 4, the cleaning liquid supplying apparatus 60 includes a main storage section 61 (first storage section) that stores cleaning liquid, a pressure-accumulating sub-storage section 62 (second storage section) that is connected to the main storage section 61 via a main flow channel 63 (first flow channel), and the six cleaning liquid ejecting sections 47 that are connected to the sub-storage section 62 via six individual flow channels 64. Further, the cleaning liquid supplying apparatus 60 includes a cleaning liquid pump 66 (liquid sending section) that is provided midway along the main flow channel 63 and sends the cleaning liquid in the main storage section 61 to the sub-storage section 62, a filter 67 that is provided midway along the main flow channel 63, and the six individual opening/closing valves 68 (individual flow channel opening/closing sections) that open/close the individual flow channels 64, respectively. Those components are controlled by the control section 17.

The main storage section 61 is formed of a stainless open tank in consideration of corrosion that may be caused by the cleaning liquid. Similarly, the sub-storage section 62 is formed of a stainless sealed tank. In the sub-storage section 62, an air reservoir 62*a* is formed at an upper part thereof, and a liquid reservoir 62*b* is formed at a lower part thereof. The sub-storage section 62 is arranged at a higher position than the main storage section 61. The cleaning liquid pump 66 pumps up the cleaning liquid in the main storage section 61 into the sub-storage section 62, and increases the pressure in the sub-storage section 62. Further, a pressure detecting section 71 (pressure sensor) that detects the internal pressure of the sub-storage section 62 is provided on the sub-storage section 62 so as to communicate with the air reservoir 62*a*. The pressure detecting section 71 is connected to the control section 17.

The main flow channel 63 is formed of, for example, a chemical-resistant tube. The cleaning liquid pump 66 and the filter 67 are connected to the main flow channel 63 via couplings (not shown). The downstream portion of the main flow channel 63 extends deeply into the sub-storage section 62, and is open to the liquid reservoir 62*b*. This configuration prevents formation of waves in the sub-storage section 62 or entry of air into the cleaning liquid when the cleaning liquid is sent to the sub-storage section 62.

The cleaning liquid pump 66 is, for example, a small diaphragm pump. The cleaning liquid pump 66 is connected to the control section 17, and the control section 17 controls driving of the cleaning liquid pump 66 based on a detection result from the pressure detecting section 71. Similarly to the main flow channel 63, each individual flow channel 64 is formed of a chemical-resistant tube. The upstream end of the individual flow channel 64 is open to the liquid reservoir 62*b* of the sub-storage section 62. Each individual opening/closing valve 68 is, for example, a chemical-resistant electromagnetic valve (two-way valve). As described above, the cleaning liquid is ejected from the cleaning liquid ejecting section 47 by opening the individual opening/closing valve 68.

Each cleaning liquid ejecting section 47 is formed of, for example, a stainless pipe, and has the plurality of ejecting ports 47*a* formed along an extending direction. In this case, the pipe-shaped cleaning liquid ejecting section 47 is formed so as to have a diameter that is sufficiently larger than that of the individual flow channel 64 for the cleaning liquid ejecting section 47 to perform a manifold function. Further, the cleaning liquid ejecting section 47 has a length corresponding to the length of the liquid droplet ejecting head 13 in the longitudinal direction. As described above, the cleaning liquid ejecting section 47 is arranged near the side surface of the liquid droplet ejecting head 13 which has moved to the wiping position.

The control section 17 controls the cleaning liquid pump 66 so that the pressure in the air reservoir 62*a* of the sub-storage section 62 becomes a predetermined pressure. Specifically, the control section 17 controls the cleaning liquid pump 66 so that the pressure in the air reservoir 62*a* becomes a predetermined pressure based on the detection result from the pressure detecting section 71. For example, an upper threshold and a lower threshold are set for the predetermined pressure in the air reservoir 62*a*, and the control section 17 activates the cleaning liquid pump 66 when the pressure has reached the lower threshold, and stops the cleaning liquid pump 66 when the pressure has reached the upper threshold.

When the liquid droplet ejecting head 13 has moved to the wiping position in response to a wiping command, the control section 17 opens the corresponding individual opening/closing valve 68. Thus, the cleaning liquid in the sub-storage section 62 is sent to the cleaning liquid ejecting section 47 under pressure, and is ejected from the plurality of ejecting ports 47*a*. The liquid droplet ejecting apparatus 10 of the embodiment is intended to drive the six maintenance units 40 simultaneously in periodic maintenance (periodic cleaning). Therefore, the cleaning liquid is simultaneously supplied to the six cleaning liquid ejecting sections 47 by simultaneously opening the six individual opening/closing valves 68.

As described above, according to the cleaning liquid supplying apparatus 60 of the first embodiment, the sub-storage section 62 is replenished with the cleaning liquid in the main storage section 61 and the pressure in the sub-storage section 62 becomes a predetermined pressure through the driving of the cleaning liquid pump 66. Therefore, the cleaning liquid in the sub-storage section 62 is sent to the cleaning liquid ejecting section 47 under pressure by opening the individual opening/closing valve 68. In this case, when sufficiently large volumes are secured for the liquid reservoir 62*b* and the air reservoir 62*a* relative to the amount of cleaning liquid to be supplied to the cleaning liquid ejecting sections 47, a necessary amount of cleaning liquid (at a constant flow rate) can be supplied to the six cleaning liquid ejecting sections 47 simultaneously even if the capacity of the cleaning liquid pump 66 is small. This configuration also enables the six maintenance units 40 to be driven simultaneously, thereby being capable of shortening the period of time for the maintenance to be performed periodically.

In the sub-storage section 62, a film that partitions the liquid reservoir 62*b* and the air reservoir 62*a* from each other in an air-tight fashion may be provided. With this film, air can be prevented from being mixed into the cleaning liquid in the sub-storage section 62, thereby facilitating volume control for the air reservoir 62*a*.

Cleaning Liquid Supplying Apparatus of Second Embodiment

Figure 5:
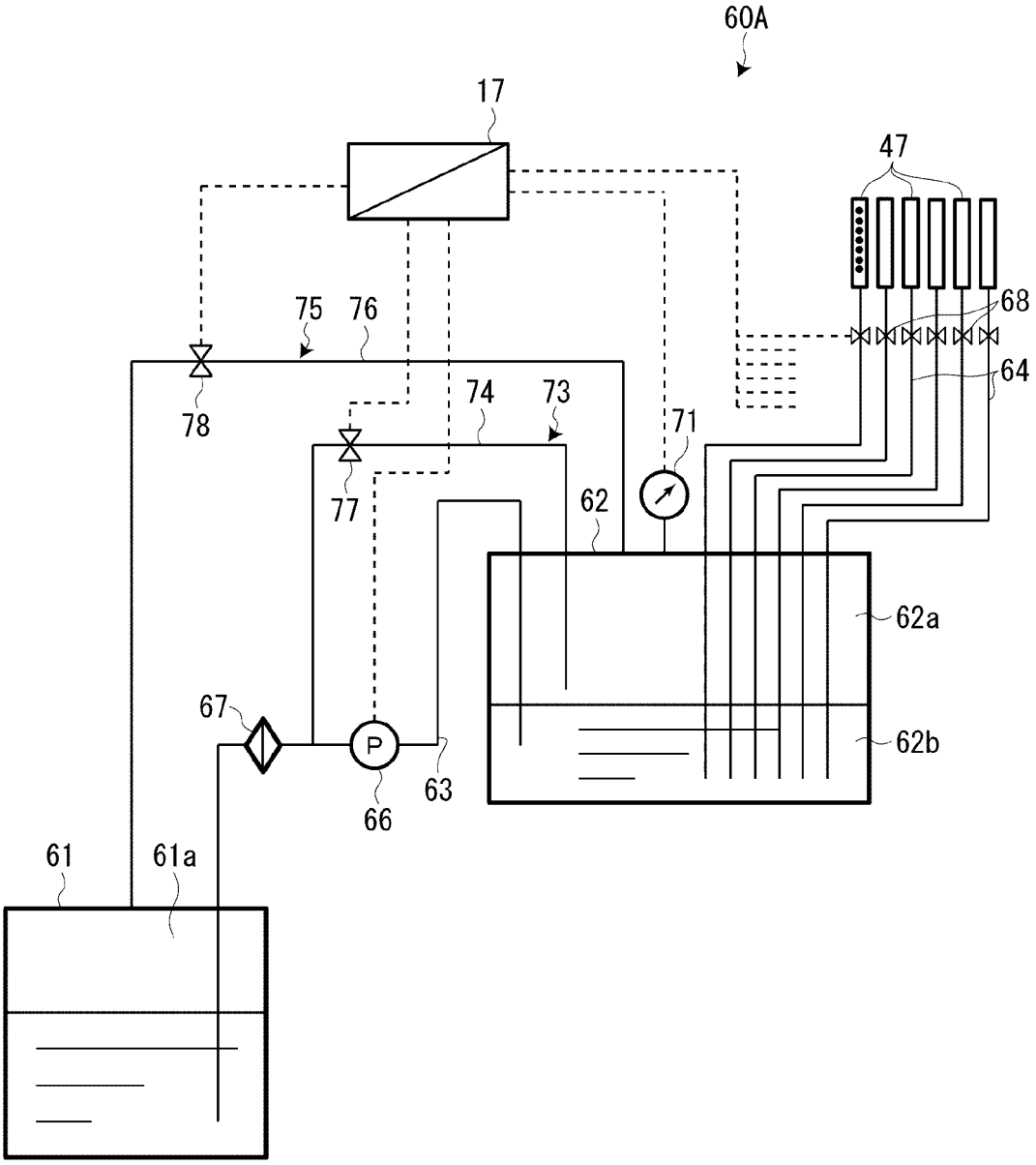
FIG. 5 is a schematic diagram of a cleaning liquid supplying apparatus according to a second embodiment.

Next, a cleaning liquid supplying apparatus 60A according to a second embodiment is described with reference to FIG. 5. In this embodiment, differences from the first embodiment are mainly described. As illustrated in FIG. 5, the cleaning liquid supplying apparatus 60A of the second embodiment includes, in addition to the components of the first embodiment, a cleaning liquid returning section 73 that includes a return flow channel 74 and returns the cleaning liquid in the sub-storage section 62 to the main storage section 61, and an atmosphere opening/closing section 75 that includes an air flow channel 76 and opens/closes the air reservoir 62*a* of the sub-storage section 62 to/from the atmosphere.

The cleaning liquid returning section 73 includes the return flow channel 74 through which the cleaning liquid in the sub-storage section 62 is returned to the main storage section 61, and a return opening/closing valve 77 (return flow channel opening/closing section) that opens/closes the return flow channel 74. Similarly to the main flow channel 63, the return flow channel 74 is formed of a chemical-resistant tube, and is connected on the upstream side to the sub-storage section 62 and also connected on the downstream side to the main flow channel 63 between the filter 67 and the cleaning liquid pump 66. The upstream end of the return flow channel 74 is open at a position corresponding to a reference liquid level (predetermined liquid level) of the liquid reservoir 62*b*.

Thus, when the cleaning liquid in the sub-storage section 62 is returned to the main storage section 61 via the return flow channel 74, the liquid level of the liquid reservoir 62*b* of the sub-storage section 62 is restored (reset) to the reference liquid level. Further, the downstream end of the return flow channel 74 is connected to the main flow channel 63 between the filter 67 and the cleaning liquid pump 66, and hence the cleaning liquid returning to the main storage section 61 passes through the filter 67 in a backflow direction to remove clogging of the filter 67. Thus, the filter 67 can be made substantially free of maintenance. The downstream end of the return flow channel 74 may be connected directly to the main storage section 61, or may be connected to a waste liquid tank (not shown).

Similarly to the individual opening/closing valve 68, the return opening/closing valve 77 is a chemical-resistant electromagnetic valve. The return opening/closing valve 77 is connected to the control section 17, and the control section 17 opens the return opening/closing valve 77 when the cleaning liquid pump 66 is stopped. In a state in which the cleaning liquid pump 66 is stopped, the pressure in the air reservoir 62*a* has reached the upper threshold. When the return opening/closing valve 77 is opened, the cleaning liquid in the sub-storage section 62 flows toward the main storage section 61 via the return flow channel 74 owing to the pressure in the air reservoir 62*a*.

Note that the description "when the cleaning liquid pump 66 is stopped" in this case may refer to a state in which all the individual opening/closing valves 68 are closed and the pump is stopped while the wiper 53 is performing one reciprocal movement, or may refer to a state in which the pump is stopped after the wiper 53 has performed reciprocal movement a plurality of times, that is, after the wiping operation is completed. Further, the above description may refer to a state in which the pump is stopped while the operation of the cleaning liquid supplying apparatus 60A or the liquid droplet ejecting apparatus 10 is stopped.

The atmosphere opening/closing section 75 includes the air flow channel 76 that opens the air reservoir 62*a* of the sub-storage section 62 to the atmosphere, and an air opening/closing valve 78 (air flow channel opening/closing section) that opens/closes the air flow channel 76. Similarly to the main flow channel 63, the air flow channel 76 is formed of a chemical-resistant tube, and is connected on the downstream side to the sub-storage section 62 and also connected on the upstream side to the main storage section 61. More specifically, the downstream end of the air flow channel 76 is open to the air reservoir 62*a* of the sub-storage section 62, and the upstream end of the air flow channel 76 is open to an atmospheric-pressure air reservoir 61*a* that is formed at the upper end of the main storage section 61.

Similarly to the individual opening/closing valve 68, the air opening/closing valve 78 is a chemical-resistant electromagnetic valve. The air opening/closing valve 78 is connected to the control section 17, and the control section 17 opens the air opening/closing valve 78 at the timing when the pressure in the air reservoir 62*a* is decreased to the atmospheric pressure after the return opening/closing valve 77 is opened. Thus, the sending out of the cleaning liquid to be returned from the sub-storage section 62 to the main storage section 61 is switched in midstream from the sending out of the cleaning liquid with the pressure in the air reservoir 62*a* to the sending out of the cleaning liquid with a siphon operation. Thus, the liquid level of the liquid reservoir 62*b* of the sub-storage section 62 is securely restored to the reference liquid level.

The configuration in which the upstream end of the air flow channel 76 is connected to the main storage section 61 is intended to prevent the vaporized cleaning liquid from being released to the atmosphere. Thus, the upstream end of the air flow channel 76 may be connected to a waste liquid tank or an exhaust air processing facility, (not shown). As long as the vaporized cleaning liquid causes no problem such as air pollution, the upstream end of the air flow channel 76 may simply be open to the atmosphere.

The operation for supplying cleaning liquid to the cleaning liquid ejecting section 47 by the control section 17 is similar to that of the first embodiment. The operation for returning cleaning liquid is performed in the following manner. In a state in which the cleaning liquid pump 66 is stopped, the control section 17 first opens the return opening/closing valve 77. Thus, the returning of cleaning liquid from the sub-storage section 62 to the main storage section 61 is started. When the returning of cleaning liquid is started and the cleaning liquid flows down to the main storage section 61, the pressure in the sub-storage section 62 (air reservoir 62*a* ) is gradually decreased.

When the pressure detecting section 71 has detected a predetermined pressure close to the atmospheric pressure, the control section 17 opens the air opening/closing valve 78. The main storage section 61 is arranged at a lower position than the sub-storage section 62, and due to the flow of cleaning liquid up until that time point, the air in the return flow channel 74 has flowed out, and hence the return flow channel 74 is filled with the cleaning liquid. Thus, when the air opening/closing valve 78 is opened, the flow of cleaning liquid continues while being switched from the flow with the pressure in the air reservoir 62*a* to the flow with the siphon operation. When the liquid level of the sub-storage section 62 has reached the reference liquid level (position at the upstream end of the return flow channel 74), air flows into the return flow channel 74, and the siphon operation is terminated. Thus, the flow (returning) of cleaning liquid is stopped.

The termination of the siphon operation (stop of the returning of cleaning liquid) is controlled on a time basis from the time point when the pressure detecting section 71 has detected the predetermined pressure close to the atmospheric pressure. After a predetermined period of time has elapsed from the time point when the pressure detecting section 71 has detected the predetermined pressure, the control section 17 closes the return opening/closing valve 77 and the air opening/closing valve 78, and completes the operation for returning cleaning liquid.

As described above, according to the cleaning liquid supplying apparatus 60A of the second embodiment, the operation for returning cleaning liquid is performed when the cleaning liquid pump 66 is stopped, and hence the liquid reservoir 62*b* and the air reservoir 62*a* of the sub-storage section 62 can be reset to the original conditions. Specifically, the liquid level of the liquid reservoir 62*b* of the sub-storage section 62 can be reset to the reference liquid level. That is, the volumes of the liquid reservoir 62*b* and the air reservoir 62*a* can be reset to desired volumes even if the air in the air reservoir 62*a* is mixed into the cleaning liquid in the liquid reservoir 62*b*.

Further, the operation for returning cleaning liquid is performed by using the pressure in the air reservoir 62*a* and the siphon operation, and hence the structure for the returning operation can be simplified. Thus, the cleaning liquid supplying apparatus 60A that is free of maintenance and is reduced in cost can be provided.

Cleaning Liquid Supplying Apparatus of Third Embodiment

Figure 6:
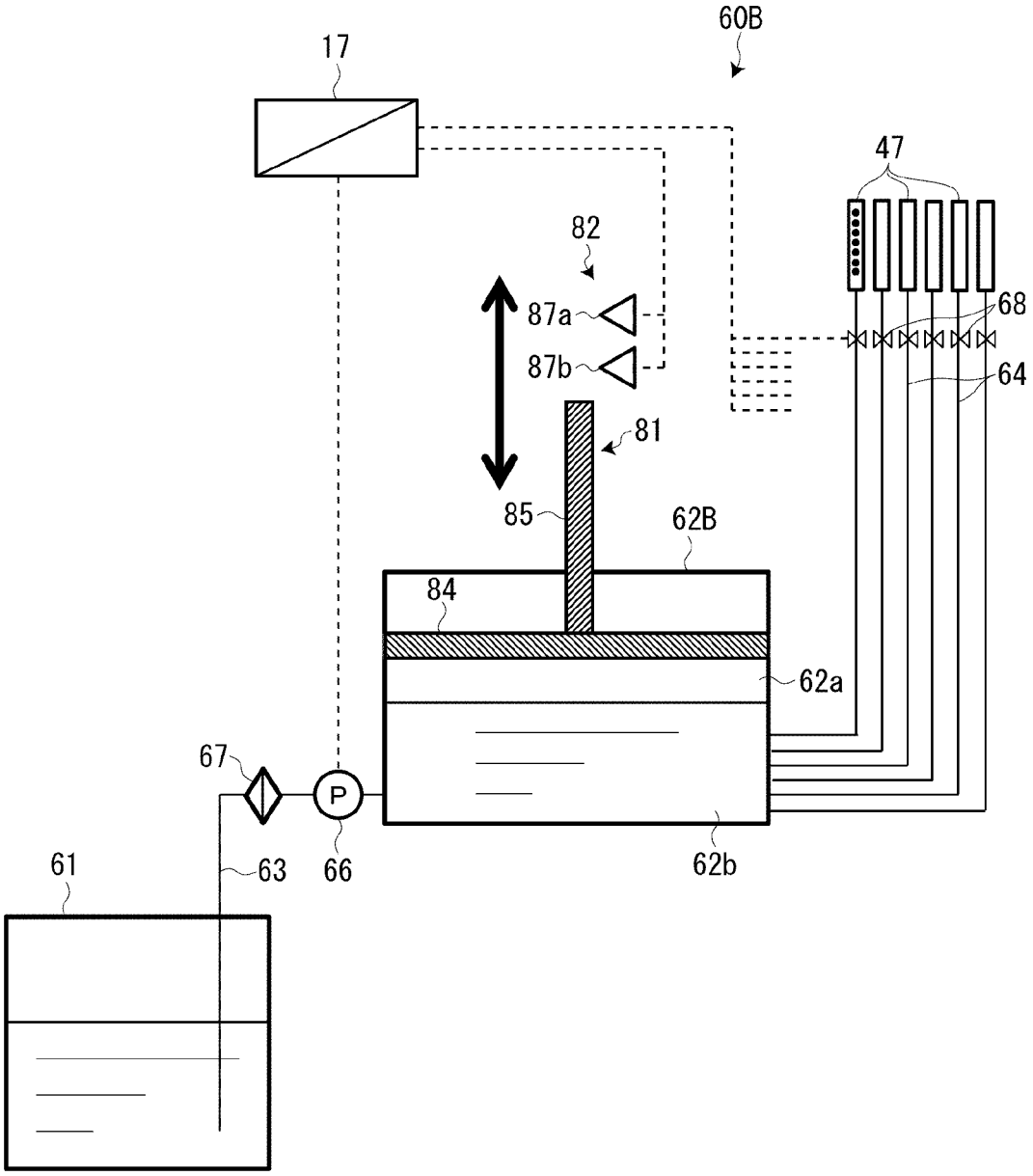
FIG. 6 is a schematic diagram of a cleaning liquid supplying apparatus according to a third embodiment.

Next, a cleaning liquid supplying apparatus 60B according to a third embodiment is described with reference to FIG. 6. In this embodiment, differences from the first embodiment are mainly described. As illustrated in FIG. 6, in the cleaning liquid supplying apparatus 60B of the third embodiment, a sub-storage section 62B has a structure different from that of the sub-storage section 62 of the first embodiment. In the sub-storage section 62B of the third embodiment, a piston-like member 81 is provided in the air reservoir 62*a* in a freely ascending/descending fashion. Further, a position detecting section 82 that detects the position of the piston-like member 81 in the ascending/descending direction is provided.

The piston-like member 81 is formed of a chemical-resistant resin or the like, and includes a piston body 84 and a rod portion 85 extending from the piston body 84. The piston body 84 is provided on the inner peripheral surface of the sub-storage section 62B in an air-tight fashion and in a freely ascending/descending fashion. In this case, the piston-like member 81 ascends/descends with a balance between the weight of the piston-like member 81 and the pressure in the air reservoir 62*a*.

The position detecting section 82 is provided in place of the pressure detecting section 71, and is constituted by a pair of upper/lower photosensors 87*a* and 87*b*. The pair of photosensors 87*a* and 87*b* is arranged vertically so as to face the rod portion 85 of the ascending/descending piston-like member 81. The position of the upper photosensor 87*a* corresponds to the upper threshold described above, and the position of the lower photosensor 87*b* corresponds to the lower threshold described above.

The control section 17 activates the cleaning liquid pump 66 when the lower photosensor 87*b* has detected that the rod portion 85 is "absent", and stops the cleaning liquid pump 66 when the upper photosensor 87*a* has detected that the rod portion 85 is "present". Thus, the pressure in the sub-storage section 62B is maintained at the predetermined pressure, and the cleaning liquid in the sub-storage section 62B is sent to the cleaning liquid ejecting section 47 under pressure by opening the individual opening/closing valve 68.

As described above, according to the cleaning liquid supplying apparatus 60B of the third embodiment, the cleaning liquid pump 66 is controlled based on the detection result from the position detecting section 82, and hence the pressure in the sub-storage section 62B can indirectly be controlled so as to become the predetermined pressure. Even if an abrupt pressure fluctuation has occurred on the cleaning liquid pump 66 (diaphragm pump) side or the cleaning liquid ejecting section 47 side, the pressure fluctuation can be absorbed by the ascending/descending of the piston-like member 81. Thus, the cleaning liquid can stably be supplied to each cleaning liquid ejecting section 47.

As the position detecting section 82, a linear encoder, a microswitch or a proximity switch may be used.

This application claims priority under 35 U.S.C. § 119 to Japanese Patent Application No. 2016-057498, filed Mar. 22, 2016. The entire disclosure of Japanese Patent Application No. 2016-057498 is hereby incorporated herein by reference.

What is claimed is:

1. A cleaning liquid supplying apparatus, comprising:

a first storage section adapted to stores cleaning liquid;

a pressure-accumulating second storage section that is connected to the first storage section via a first flow channel and includes an air reservoir formed at an upper part of the second storage section and a liquid reservoir formed at a lower part of the second storage section, the liquid reservoir being adapted to store a predetermined amount of the cleaning liquid;

a plurality of cleaning liquid ejecting sections that are connected to the second storage section via a plurality of individual flow channels having upstream ends located at positions where the upstream ends are open to the liquid reservoir at the lower part of the second storage section;

a liquid sending section that is provided midway along the first flow channel and that is adapted to send the cleaning liquid in the first storage section to the second storage section;

a plurality of individual flow channel opening/closing sections that open/close the respective individual flow channels; and a control section that controls the liquid sending section so that a pressure in the air reservoir becomes a predetermined pressure.

2. The cleaning liquid supplying apparatus according to claim 1, wherein a downstream end of the first flow channel is located at a position where the downstream end is open to the liquid reservoir at the lower part of the second storage section.

3. A liquid droplet ejecting apparatus, comprising:

the cleaning liquid supplying apparatus according to claim 2;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

4. The cleaning liquid supplying apparatus according to claim 1, further comprising a cleaning liquid returning section that includes a return flow channel through which the cleaning liquid in the second storage section is returned to the first storage section and, when the liquid sending section is stopped by the control section, is adapted to return the cleaning liquid in the second storage section to the first storage section via the return flow channel so that a liquid level of the liquid reservoir becomes a predetermined liquid level.

5. The cleaning liquid supplying apparatus according to claim 4, wherein the cleaning liquid returning section includes:

the return flow channel having an upstream end that is open at a position of the predetermined liquid level; and a return flow channel opening/closing section that opens/closes the return flow channel, and wherein the control section controls the return flow channel opening/closing section to open the return flow channel when the liquid sending section is stopped.

6. The cleaning liquid supplying apparatus according to claim 5, further comprising a filter that is provided midway along the first flow channel between the first storage section and the liquid sending section, wherein a downstream end of the return flow channel is connected to the first flow channel between the filter and the liquid sending section.

7. A liquid droplet ejecting apparatus, comprising:

the cleaning liquid supplying apparatus according to claim 6;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

8. The cleaning liquid supplying apparatus according to claim 5, wherein the first storage section is arranged at a lower position in a gravity direction than the second storage section in use of the cleaning liquid supplying apparatus, wherein the cleaning liquid supplying apparatus further includes an atmosphere opening/closing section that is controlled by the control section to open/close the air reservoir of the second storage section to/from atmosphere, and wherein the control section opens the atmosphere opening/closing section at a timing when the pressure in the air reservoir is decreased to an atmospheric pressure after the return flow channel is opened.

9. The cleaning liquid supplying apparatus according to claim 8, wherein the first storage section includes an atmospheric-pressure air reservoir that is open to the atmosphere, and wherein the atmosphere opening/closing section includes: an air flow channel that connects the air reservoir and the atmospheric-pressure air reservoir to each other;

and an air flow channel opening/closing section that is controlled by the control section to open/close the air flow channel.

10. A liquid droplet ejecting apparatus, comprising:

the cleaning liquid supplying apparatus according to claim 9;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

11. A liquid droplet ejecting apparatus, comprising:

the cleaning liquid supplying apparatus according to claim 8;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

12. A liquid droplet ejecting apparatus, comprising:

the cleaning liquid supplying apparatus according to claim 5;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

13. A liquid droplet ejecting apparatus, comprising:

the cleaning liquid supplying apparatus according to claim 4;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

14. The cleaning liquid supplying apparatus according to claim 1, further comprising a pressure detecting section that detects the pressure in the second storage section, wherein the control section controls the liquid sending section based on a detection result from the pressure detecting section.

15. The cleaning liquid supplying apparatus according to claim 14, further comprising:

a piston-like member that is provided on an inner peripheral surface of the second storage section so as to form an air-tight seal and that is arranged to freely ascend/descend within the second storage section so as to ascend/descend with a balance between a weight of the piston-like member and the pressure of air in the air reservoir; and a position detecting section that is provided as the pressure detecting section and detects a position of the piston-like member in an ascending/descending direction, wherein the control section controls the liquid sending section based on a detection result from the position detecting section.

16. A liquid droplet ejecting apparatus, comprising:

the cleaning liquid supplying apparatus according to claim 15;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

17. A liquid droplet ejecting apparatus, comprising:

the cleaning liquid supplying apparatus according to claim 14;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

18. A liquid droplet ejecting apparatus, comprising:

the cleaning liquid supplying apparatus according to claim 1;

a plurality of liquid droplet ejecting heads that eject functional liquid and are provided so as to correspond to the plurality of cleaning liquid ejecting sections; and a plurality of wiping apparatuses that wipe nozzle surfaces of the respective liquid droplet ejecting heads in a state in which the cleaning liquid is supplied from the respective cleaning liquid ejecting sections to the nozzle surfaces.

* * * * *